United States Patent [19]

Taguchi et al.

[11] Patent Number: 4,586,458

[45] Date of Patent: May 6, 1986

[54] COATING APPARATUS FOR SCRATCHES OF GLASS BOTTLE

[75] Inventors: Kazuo Taguchi, Suita; Yogiro Okawa, Takatsuki, both of Japan

[73] Assignee: Asahi Breweries Ltd., Tokyo, Japan

[21] Appl. No.: 725,054

[22] Filed: Apr. 19, 1985

[30] Foreign Application Priority Data

| | | | |
|---|---|---|---|
| Apr. 27, 1984 | [JP] | Japan | 59-62425[U] |
| May 7, 1984 | [JP] | Japan | 59-66256[U] |
| Jul. 24, 1984 | [JP] | Japan | 59-111959[U] |
| Mar. 12, 1985 | [JP] | Japan | 60-35275[U] |

[51] Int. Cl.[4] ..... B05C 1/02

[52] U.S. Cl. ..... 118/72; 118/112; 118/109; 118/210; 118/219; 118/230

[58] Field of Search ..... 118/230, 232, 233, 219, 118/112, 210, 72, 109

[56] References Cited

U.S. PATENT DOCUMENTS

| | | | |
|---|---|---|---|
| 2,495,174 | 1/1950 | McClatchie | 118/230 X |
| 3,710,753 | 1/1973 | Birchall et al. | 118/232 X |
| 4,308,818 | 1/1982 | Abe et al. | 118/230 X |

*Primary Examiner*—John P. McIntosh

*Attorney, Agent, or Firm*—Flynn, Thiel, Boutell & Tanis

[57] ABSTRACT

A coating apparatus for the scratches of a glass bottle comprises: a rotary disc for rotating and transferring the bottle; a coating roller which is eccentrically provided and applies coating liquid to the barrel surface of the bottle transferred by the rotary disc; a feed roller for feeding the coating liquid to the periphery of the coating roller and a feed member for feeding the coating liquid to the feed roller; a driving unit for rotating the feed roller together with the coating roller and a control equipment for controlling an output of the driving unit; and a bottle holding member for holding the upper and the lower portions of the bottle when the application of the bottle with the coating liquid is performed by the coating roller; wherein, the rotational speed of each of the above rollers is controlled by the control equipment.

4 Claims, 13 Drawing Figures

COATING APPARATUS FOR SCRATCHES OF GLASS BOTTLE

BACKGROUND OF THE INVENTION

1. Field of the Invention

The present invention relates to a coating apparatus for scratches of a glass bottle of beer or soft drinks such as aerated drink, cola and similar drinks, which scratches appear on the barrel surface of the glass bottle.

2. Description of the Prior Art

The glass bottles rub mainly together in their bottling and transporting operations to produce the scratches on their barrel surface, which scratches appear, for example, usually as a whity band in the barrel surface of the beer bottle and the like. Under the existing circumstances, as the number of times of recovery and re-use of the glass bottle increases, the glass bottle deteriorates in its appearance due to such barrel scratches so that the bottled drink deteriorates its product value. As a means for preventing such deterioration of the product value, there has been developed a conventional coating apparatus for the scratches of the bottle in which apparatus a coating liquid is applied onto the scratched barrel surface of the bottle by means of a coating roller. As shown in FIG. 1, the conventional coating apparatus comprises: a transfer unit 152 constructed of a rotary disc on which the bottle 151 is placed and transferred in rotatable manner; a coating roller 153 which is eccentrically provided relative to the rotary disc so that a peripheral surface of the coating roller 153 is brought into contact with the barrel surface of the transferred bottle 151 in slidable manner to apply the coating liquid of the barrel surface of the bottle 151; an intermediate roller 154 and a feed roller 155 for uniforming in thickness the coating liquid into a thin film which is applied to the peripheral surface of the coating roller 153; and a spray gun for spraying the coating liquid to feed the same to the feed roller 155; wherein the barrel surface of the bottle 151 is brought into contact with the peripheral surface of the rotating coating roller 153 in slidable manner to apply the coating liquid from the coating roller 153 to the barrel surface of the bottle 151 when the bottle 151 is transferred to area "C" by means of the transfer unit 152.

However, in the above conventional apparatus, since each of the rollers 153, 154, 155 rotates at its fixed rotational speed, an amount of the coating liquid fed in the form of the thin film to the coating roller 153 from the feed roller 155 through the intermediate roller 154 remains always constant even when an amount of the coating liquid fed through the spray gun 156 is varied. Consequently, it is impossible to vary an amount of the coating liquid applied to the barrel surface of the bottle 151 from the coating roller 153. As a result, in case that many scratches exist in the barrel surface of the bottle 151, it is impossible to increase an amount of the coating liquid applied to the barrel surface of the bottle 151, or in contrast with this, in case that few scratches exist in the barrel surface of the bottle 151, it is impossible to decrease the amount of the coating liquid applied to the barrel surface of the bottle 151, whereby an application efficiency of the coating liquid is very poor. This is one of the defects inherent in the conventional apparatus. Further, in the conventional apparatus, an excess amount of the coating liquid applied to the barrel surface of the bottle 151 is wiped away from the barrel surface of the bottle 151 by means of a wiper belt (not shown) to make the barrel surface smooth and frictional. However, since the wiper belt is made of cotton fabrics, the coating liquid can not be sufficiently wiped away from the barrel surface of the bottle 151 to make the barrel surface frictionless whereby a dropping accident of the bottle 151 occurs frequently when the user takes up the bottle 151 by holding the barrel surface thereof with his hand in case that he pours the bottled drink from the bottle 151 after the bottle 151 is delivered as a product. This is another defect inherent in the conventional apparatus. Further, in the conventional apparatus, the bottl 151 is rinsed with water before the coating liquid is applied thereto. However, water vapor tends to condense into water droplets on a lower area of the barrel surface of the bottle 151 to prevent the coating liquid from being sufficiently applied to such lower area of the barrel surface of the bottle 151. This is further another defect of the conventional apparatus. Furthermore, in the conventional apparatus, the coating liquid of the single kind is fed to the barrel surface of the bottle. Consequently, although it is possible to make the barrel surface frictional so as to reduce the slippage accident of the bottle due to characteristics of the coating liquid, provided that the coating liquid is made up of a relatively hydrophilic emulsion (fatty acid ester of sorbitan, monoester of glycerol and the like) containing dimethyl silicone as its main dispersoid element, there exists another defect that the feeling of such coating liquid can not solely provide a sufficient coating for the lower area of the barrel surface of the bottle 151 which has been rinsed with water and dried incompletely to be wet with the condensed water vapor.

SUMMARY OF THE INVENTION

It is an object of the present invention to provide a coating apparatus for the scratches of the glass bottle, which apparatus can eliminate the above-mentioned defects of the conventional apparatus for the scratches of the glass bottle, and makes both the coating roller and the feed roller controllable in their rotational speeds so that an applied amount of the coating liquid from the coating roller is varied.

According to the present invention, the above object of the present invention is accomplished by providing a coating apparatus for the scratches of the glass bottle comprising: in combination a rotary disc which is mounted on a central shaft rotated by a first driving unit and is provided with a bottle-feed portion in one side of its rotational direction and a bottle-discharge portion in another side of its rotational direction; a coating roller which is rotatably supported by said central shaft of said rotary disc and makes its rotational center eccentric relative to a center of said central shaft toward a direction opposite to a direction where the bottle-feed and bottle-discharge portions of said rotary disc exist so taht a peripheral surface of said coating roller is brought into slidable contact with a barrel surface of said bottle transferred on said rotary disc to apply coating liquid to the barrel surface of said bottle; a feed roller which abuts against the peripheral surface of said coating roller to rotate together with the same so that the coating liquid is fed to the peripheral surface of said coating roller from said feed roller; a feed member for feeding the coating liquid to a peripheral surface of said feed roller; a second driving unit rotatable together with said feed roller and said coating roller; a control equipment for controlling the output of said second driving unit to regulate the rotational speed of each of said rollers; and a bottle holding member for holding an upper and an lower portions of said bottle in a manner that, in application of the coating liquid through said coating roller, said bottle is held rotatably relative to said rotary disc to enable the barrel surface of said bottle to be brought into slidable contact with the peripheral surface of said coating roller.

Namely, in case that it is necessary to increase an amount of the coating liquid to be applied to the bottle due to many scratches existing in the barrel surface of the bottle, the rotational speeds of the feed roller and the coating roller which are driven by the second driving unit are increased under the control of the control equipment to increase the rotational speed of the bottle so that the amount of the coating liquid to be applied to the bottle increased. On the other hand, in case that there are few scratches on the barrel surface of the bottle so that there is no trouble when the amount of the coating liquid to be applied to the barrel surface of the bottle is reduced, the rotational speeds of the feed roller and the coating roller are reduced by the control equipment to increase the rotational speed of the bottle so that the amount of the coating liquid to be applied to the bottle is reduced. According to the above construction, it is possible to vary the amount of the coating liquid to be applied to the barrel surface of the bottle in proportion to the amount of the scratches.

It is another object of the present invention to provide a coating apparatus for the scratches of the glass bottle, which apparatus enables an application area of the barrel surface of the bottle to be smooth and frictional by adequately polishing the same area after the area is applied with the coating liquid.

According to the present invention, the above another object of the present invention is accomplished by providing an embodiment of the present invention, which embodiment comprises: a lateral rotary brush roller which is disposed adjacent to an outer peripheral surface position in a bottle-discharge side of the rotary disc and slidably abuts in its outer peripheral surface against an upper portion of the coating liquid application area of the barrel surface of the bottle which is transferred while rotated and applied in its barrel surface with the coating liquid through the coating roller, so that the application area of the bottle which has been applied with the coating liquid is polished by the brush roller; and a driving unit for rotatably driving the brush roller.

It is further object of the present invention to provide a coating apparatus for the scratches of the glass bottle, which apparatus eliminates the condensed water vapor perfectly from a lower area of the barrel surface of the bottle before application of the coating liquid to the bottle to enable the coating liquid to be applied to the bottle in a good condition.

According to the present invention, the abov further another object of the present invention is accomplished by providing another embodiment of the present invention, which embodiment comprises: a lateral rotary brush roller which is disposed adjacent to an outer peripheral surface position in a bottle-feed side of the rotary disc and slidably abuts in its outer surface against a lower portion of the coating liquid application area of the barrel surface of the bottle which is transferred from a bottle-feed portion while rotated so taht the condensed water vapor adhered to the lower area of the barrel surface of the bottle is removed by the rotary brush roller; and a driving unit for rotatably driving the rotary brush roller.

It is further another object of the present invention to provide a coating apparatus for the scratches of the glass bottle, in which apparatus a coating liquid which is made up of, for example, a relatively hydrophilic component is applied to the upper area of the barrel surface of the bottle which upper area dries easily and is held frequently by the user's hand in use, while another coating liquid which is made up of, for example, a relatively hydrophobic component is applied to the lower area of the barrel surface of the bottle which lower area is hard to dry so that it is frequently in a wet condition.

According to the present invention, the above object of the present invention is accomplished by providing an embodiment of the present invention, in which embodiment: the coating roller is provided with coating portions in its upper and lower peripheral surfaces which coating portions apply the coating liquid to the corresponding upper and lower areas of the barrel surface of the bottle; and the feed roller is constructed of two rollers which may apply different types of the coating liquid to peripheral surfaces of the above coating portions of the coating roller, respectively.

DESCRIPTION OF THE PREFERRED EMBODIMENTS

Figure 1:
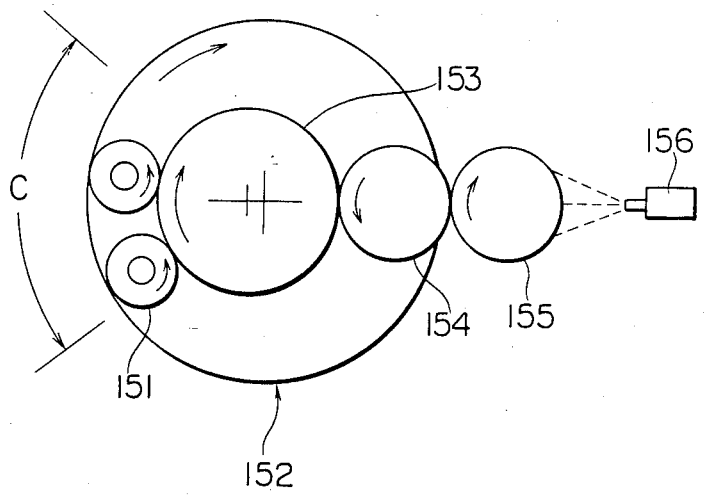
FIG. 1 is a plan view of an outline of the conventional type of a coating apparatus for the scratches of the glass bottle.
Figure 2:
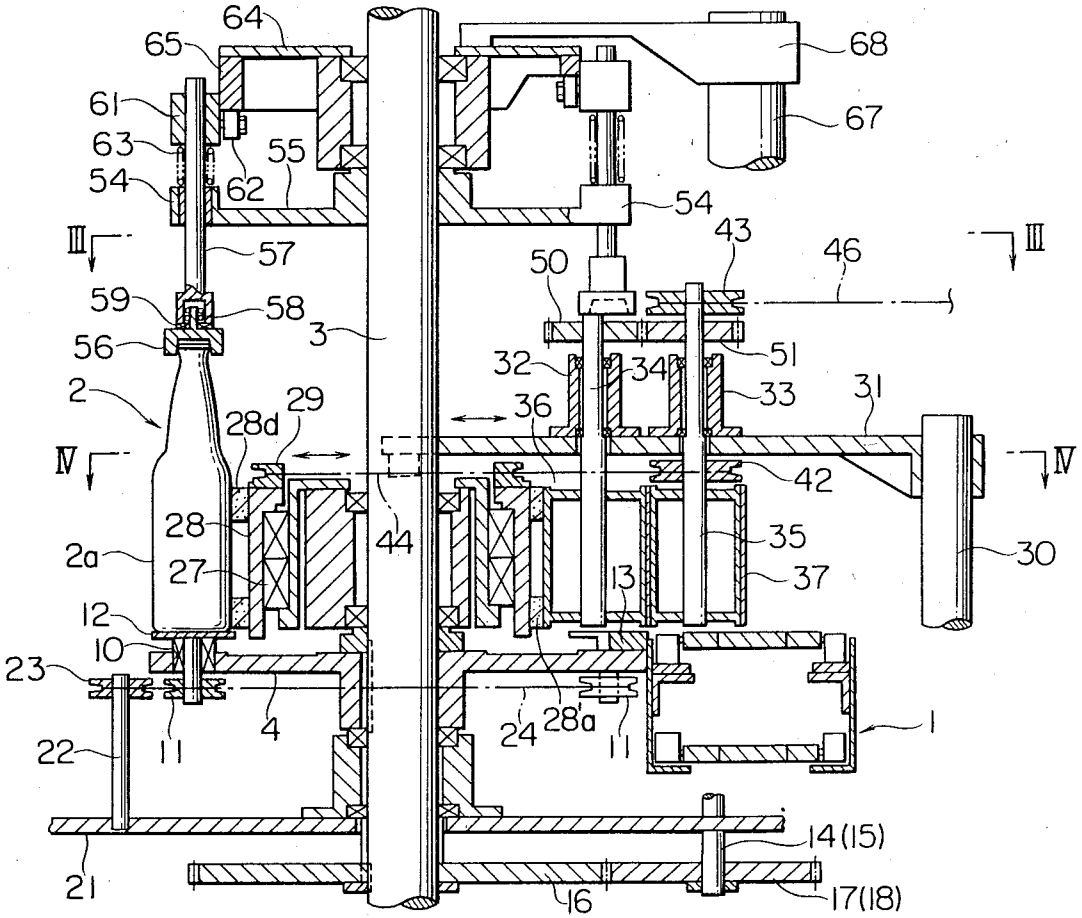
FIG. 2 is a longitudinal sectional front view of the coating apparatus for the scratches of the glass bottle according to the present invention.
Figure 4:
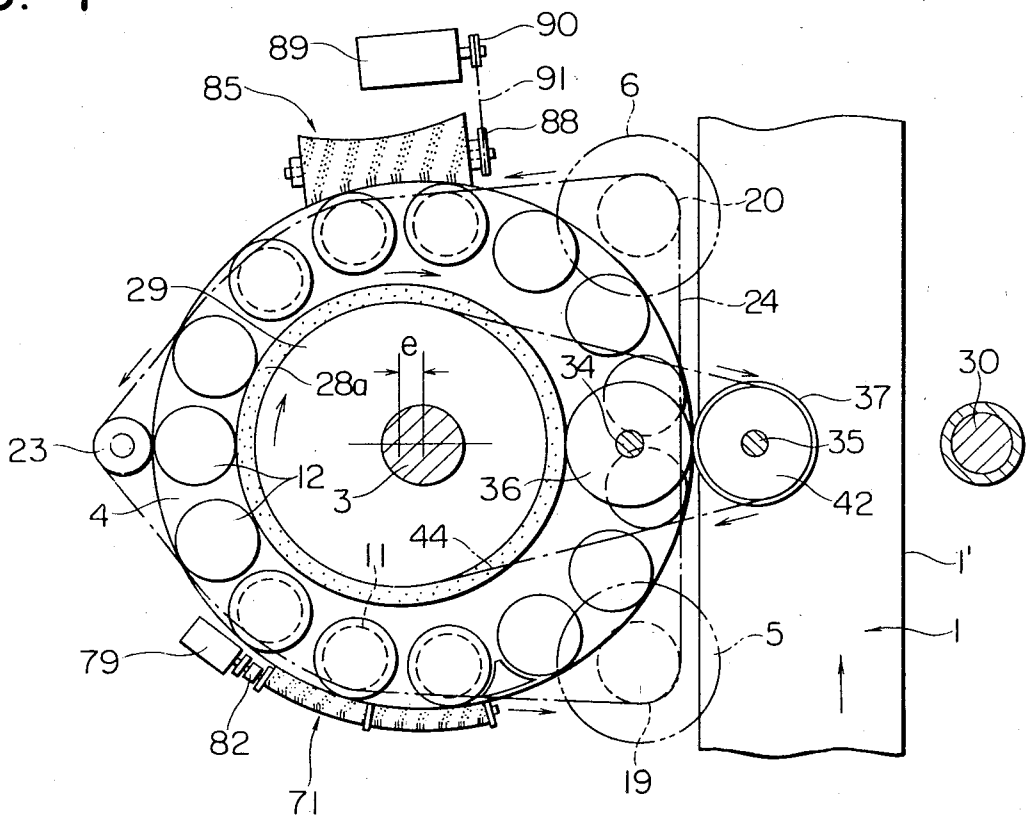
FIG. 4 is a cross sectional view taken along the line IV—IV of FIG. 2.
Figure 5:
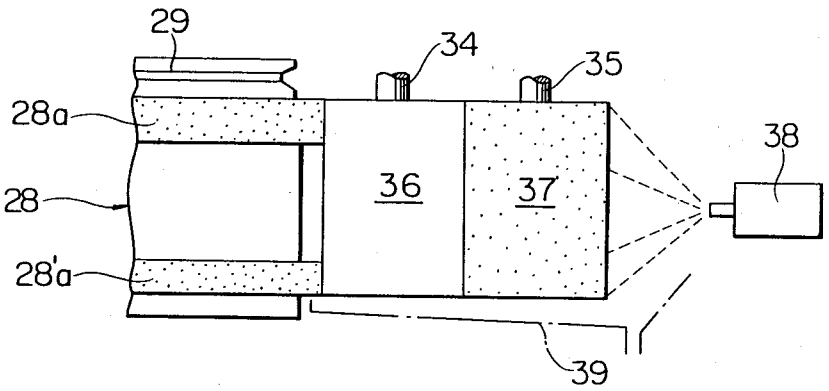
FIG. 5 is an enlarged front view of the coating liquid feed portion.
Figure 6:
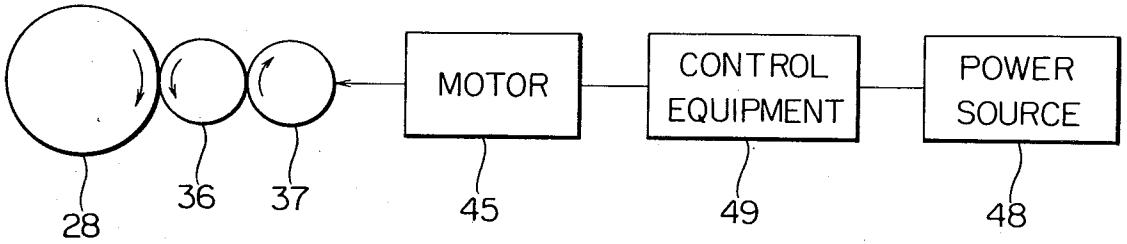
FIG. 6 is a block diagram showing the control system of the motor for rotatably driving the feed roller and the coating roller.

In FIGS. 2 and 4, the reference numeral 1 designates a conveyance path of a beer bottle 2, which is constructed of a conveyer 1. A rotary disc 4 is mounted on a driving shaft 3 in its center to make its periphery adjacent to a side of the conveyance path 1. The numeral 5 and 6 designate an entrance and an exit star wheels, respectively. The numerals 7 and 8 designate guide frames which are provided outside and spaced apart from the star wheels 5 and 6 respectively to provide spaces enabling a barrel surface 2*a* of the bottle 2 to pass therethrough, and are provided with resilient frictional members 9, for example, made of sponge and the like in their corresponding portions opposite to and contacting the barrel surface 2*a* of the bottle 2 which is transferred through the conveyance path 1 and fed to the rotary disc 4 by means of both the star wheels 5, 6 and the guide frames 7, 8 and thereafter discharged from the rotary disc 4 to the conveyance path 1 again. In a peripheral portion of the rotary disc 4 are provided a plurality of through-holes 10 in a circumferential direction thereof at equal intervals. A bottle mount 12 is provided with a pulley 11 in its lower portion and is rotatably supported by the rotary disc 4 through the throuth-hole 10; Each gap between the bottle mounts 12 is bridged by a bottle bridging plate 13 fixed to the rotary disc 4, the surface of which plate 13 is substantially flush with those of the bottle mount 12 and the conveyance path 1. On axles 14 and 15 of the star wheels 5 ans 6 are mounted respectively gears 17 and 18 which mesh with a gear 16 mounted on the driving shaft 3 so that the rotations of the star wheels 5, 6 are associated with that of the rotary shaft 4. On the wheel axles 14 and 15 are mounted pulleys 19 and 20 respectively, while a pulley 23 is mounted on an axle 22 provided upright in a machine frame 21 which is in the vicinity of a portion of the rotary disc 4 which portion is opposite to the other portion of the rotary disc 4 which other portion is in the vicinity of the star wheels 5, 6, so that the pulleys 19, 20, 23 are provided to be flush with the pulley 11 of the bottle mount 12. A V-belt 24 runs around the pulleys 19, 20, 23 to be brought into partial contact with the pulley 11 so that the bottle mount 12 of the pulley 11 is rotated relative to the rotary disc 4 when the V-belt runs. A coating roller 28 is eccentrically and rotatably supported by the driving shaft 3 through a bearing 27 above the rotary disc 4, a center of which coating roller 28 is off-centered in a direction opposite to the star wheel 5, 6 from the center of the driving shaft 3 by a desired amount "e" of the eccentricity. The coating roller 28 is provided with coating portions 28*a*, 28*a*' which have sponge-linings and exist in an upper and a lower areas of a peripheral surface of the coating roller 28, which upper and lower areas correspond to an upper and a lower areas of the barrel surface 2*a* of the bottle 2. On a top portion of the coating roller 28 is mounted a pulley 29. A front end of an arm 31 which is supported by a supporting post 30 to extend in a direction perpendicular to the conveyance path 1 is detachably attached to the coating roller 28 to make it possible that the above-mentioned amount "e" of the eccentricity is suitably adjusted. Rotary shafts 34 and 35 are supported by the arm 31 through bearings 32 and 33 respectively. On the rotary shafts 34 and 35 are mounted an intermediate roller 36 made of stainless steel and a feed roller 37 having a sponge lining in its peripheral surface respectively to rotatably abut against each other, while the intermediate roller 36 further rotatably abuts against the coating roller 28. As shown in FIG. 5, the coating liquid is pumped from a tank (not shown) to be sprayed on the peripheral surface of the feed roller 37 through a spray gun 38 so that the coating liquid is further transferred to the intermediate roller 36 to be uniformed in thickness into a thin film which is transferred to the coating portions 28*a*, 28*a*' of the coating roller 28. A tray 39 is provided under the feed roller 37 and the intermediate roller 36 to accumulate an excess amount of the coating liquid fed to these rollers 36, 37 so that the accumulated coating liquid in that tray 39 is returned to the tank to be recirculated. As the coating liquid, it is desirable to use an emulsion containing dimethyl silicone as its main dispersoid, for example, fatty acid eater of sorbitan, monoester of glycerol and the like. Pulleys 42 and 43 are mounted on a lower portion and an upper portion of the rotary shaft 35, respectively. A V-belt 44 runs around the pulley 42 and the pulley 29 of the coating roller 28, while another V-belt 46 runs around the pulley 43 and a pulley (not shown) mounted on a rotary shaft of a driving motor 45 shown in FIG. 6. In FIG. 6, the numeral 48 designates a power source for supplying an electric power to the motor 45. The numeral 49 designates a control equipment for controlling a rotational speed of the motor 45, which control equipment 49 regulates with the use of thyristor and the like, the voltage, frequency and so on impressed to the motor 45.

The numerals 50 and 51 designate gears mounted on the rotary shafts 34 and 35 respectively to mesh with each other. The numeral 53 designates an arm branch mounted on the arm 31, with which arm branch 53 the guide frames 7, 8 are held.

On the other hand, another rotary disc 55 is mounted on the upper portion of the driving shaft 3, which rotary disc 55 is similar to the rotary disc 4 in size and has the same numbers of supporting boss portions 54 as those of the bottle mounts 12 in its peripheral portion corresponding to that of the bottle mount 12. A vertically movable lever 57 provided with a holder head 56 in its lower end is supported by the boss portion 54, with which holder head 56 an upper portion of the bottle 2 held in its lower portion by the bottle mount 12 is rotatably held. The holder head 56 is connected to the vertically movable lever 57 through a spring 58 and a thrust bearing 59. A cam roller 62 is mounted inside a mounting portion 61 of the upper portion of the lever 57. A spring 63 is interposed between such mounting portion 61 and the boss portion 54 to always urge the holder head 56 upward. The cam roller 62 engages with a cam portion 65 of a cam member 64 supported by the driving shaft 3. The cam portion 65 acts to press the vertically movable lever 57 downward against the resilient force of the spring 63 during the movement of the bottle 2, which is placed on the bottle mount 12, from the entrance star wheel 5 to the exit star wheel 6. The cam member 64 is fixed to an arm 68 which is supported by a supporting post 67.

Figure 3:
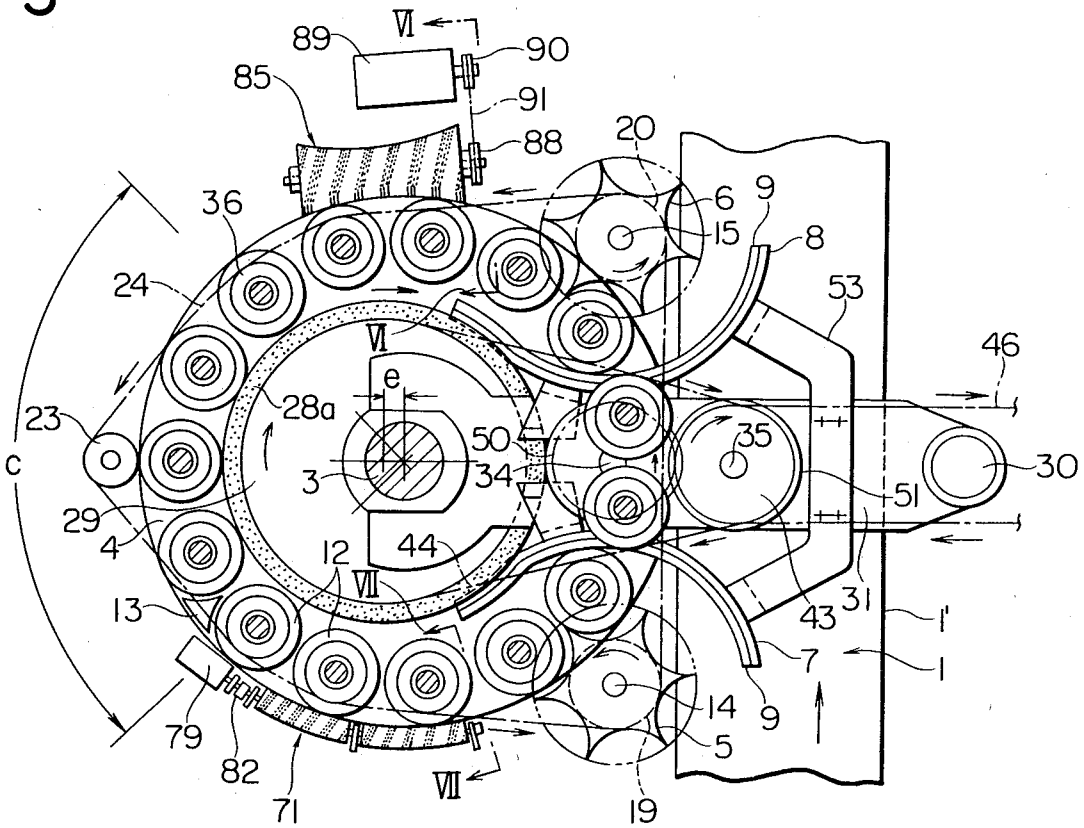
FIG. 3 is a cross sectional view taken along the line III—III of FIG. 2.
Figure 7:
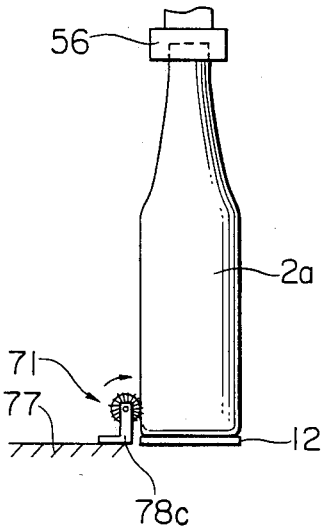
FIG. 7 is an enlarged side view of the outline of the rotary brush roller, taken along the line VII—VII of FIG. 3.
Figure 8:
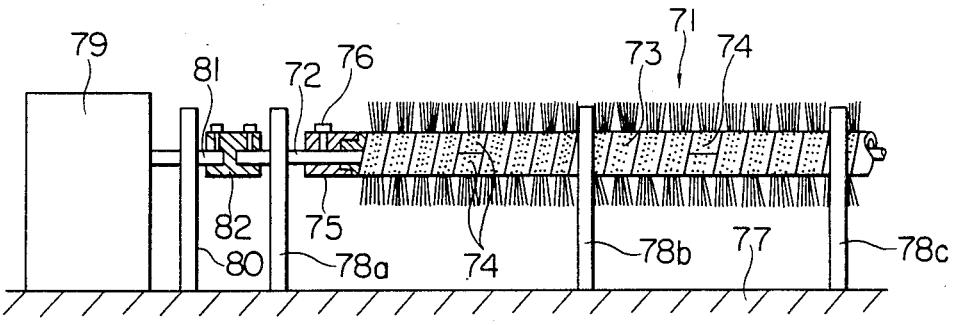
FIG. 8 is a partially broken away enlarged front view of the rotary brush roller shown in FIG. 7.

Further, as shown in FIG. 3, a rotary brush roller 71 for removing the condensed water vapor and a finishing rotary brush roller 85 are laterally disposed along the peripheral portion to the rotary disc 4 in front of and in the rear of a coating area "C" respectively, in which coating area "C" an upper and a lower area of the barrel surface 2*a* of the bottle 2 held on the bottle mount 12 above the rotary disc 4 is brought into slidable contact with the coating portions 28*a*, 28*a*' of the coating roller 28. As shown in FIGS. 3 and 4, the brush roller 71 curves as a whole along the peripheral portion of the rotary disc 4 in a plane to slidably abut against a plurality of the lower areas of the barrel surfaces 2*a* of the bottle 2 placed on the bottle mount 12 as shown in FIGS. 7 and 8 so that the condensed water vapor, i.e., water droplets adhered to the lower area of the barrel surface 2*a* of the bottle 2, which has been rinsed with water and dried, is removed. A rotary shaft 72 of the brush roller 71 is constructed of a flexible member such as a spring and the like, and inserted into a plurality of spiral tube portions 73 made up of horsehairs or resin fibers implanted upright in the flexible member. Adjacent ends of each of the plurality of the spiral tube portions 73 are formed into engaging portions 74. The brush roller 71 has in its opposite ends the stopper members 75 fixed to the rotary shaft 72 by setscrews 76 for fixing both the outermost ends of the plurality of the spiral tube portions 73 to the rotary shaft 72 which is rotatably supported by a plurality of bearing members 78*a*, 78*b*, 78*c* provided in upright condition on a base mount 77, an end of which rotary shaft 72 extending outward from the bearing member 78*a* is connected to a rotary shaft 81 of a driving motor 79 extending outward from a bearing member 80 of the driving motor 79.

Figure 9:
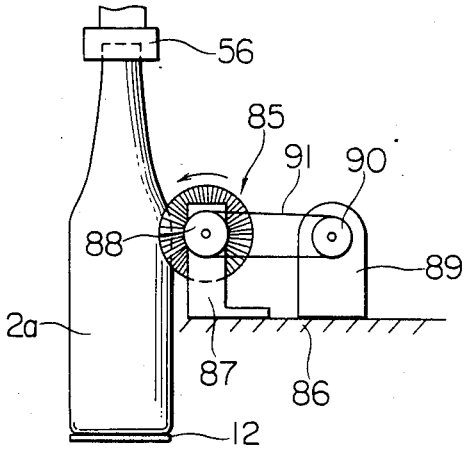
FIG. 9 is an enlarged side view of the outline of the rotary brush roller, taken along the line IX—IX of FIG. 3.

A construction of a brush roller 85 is similar to that of the above brush roller 71, namely, the brush roller 85 is so constructed that the horsehairs or the resin fibers implanted upright are provided in an outer peripheral surface of the brush roller 85. As shown in FIG. 9, a rotary shaft of the brush roller 85 is rotatably supported by a pair of bearing members 87 provided in upright condition on a base mount 86, on an end of which rotary shaft extending outward from one of the bearing members 87 is mounted a pulley 88 around which and another pulley 90 mounted on a rotary shaft of a driving motor 89 a V-belt 91 runs. Although only one of the brush roller 85 is provided in this embodiment of the present invention, it is possible to provide a plurality of the brush rollers 85 along the outer peripheral portion of the rotary disc 4 each of which brush rollers 85 is rotatably driven by each individual driving motor. Further, although the brush roller 85 slidably abuts against only the upper area of the barrel surface 2*a* of the bottle in the above embodiment of the present invention, it is possible to have the brush rollers 85 abut against the lower area of the barrel surface 2*a* of the bottle too in a similar manner as in the upper area of the barrel surface 2*a* of the bottle in addition to the same upper area thereof if necessary.

Next, the action of the above embodiment of the present invention will be hereinbelow described.

When the driving shaft 3 is rotatably driven be a motor (not shown), the rotary disc 4, 55 and the star wheels 5, 6 are rotated in opposite directions with each other, i.e., the rotary disc 4, 55 rotates in a direction opposite to a direction in which the star wheels 5, 6 rotate. Under the effect of the rotational movements of the star wheels 5, 6, the V-belt 24 running around the pulley 23 and the pulleys 19 and 20 which are mounted on the wheel axles 14 and 15 respectively is rotatably moved so that the bottle mounts 12, which are sequentially transferred according to the movement of the rotary disc 4 to be brought into contact with the above V-belt 24, are rotated.

On the other hand, when the rotary shaft 35 of the feed roller 37 is rotatably driven by the motor 45 through the V-belt 46, the intermediate roller 36 is rotated through the gears 50, 51 in a direction opposite to a direction in which the feed roller 37 is rotated while the coating roller 28 is rotated through a V-belt 44 in the same direction as the rotary disc 4 rotates. Further, the brush rollers 71 and 85 are rotated when motors 79 and 89 are actuated, respectively.

Figure 10:
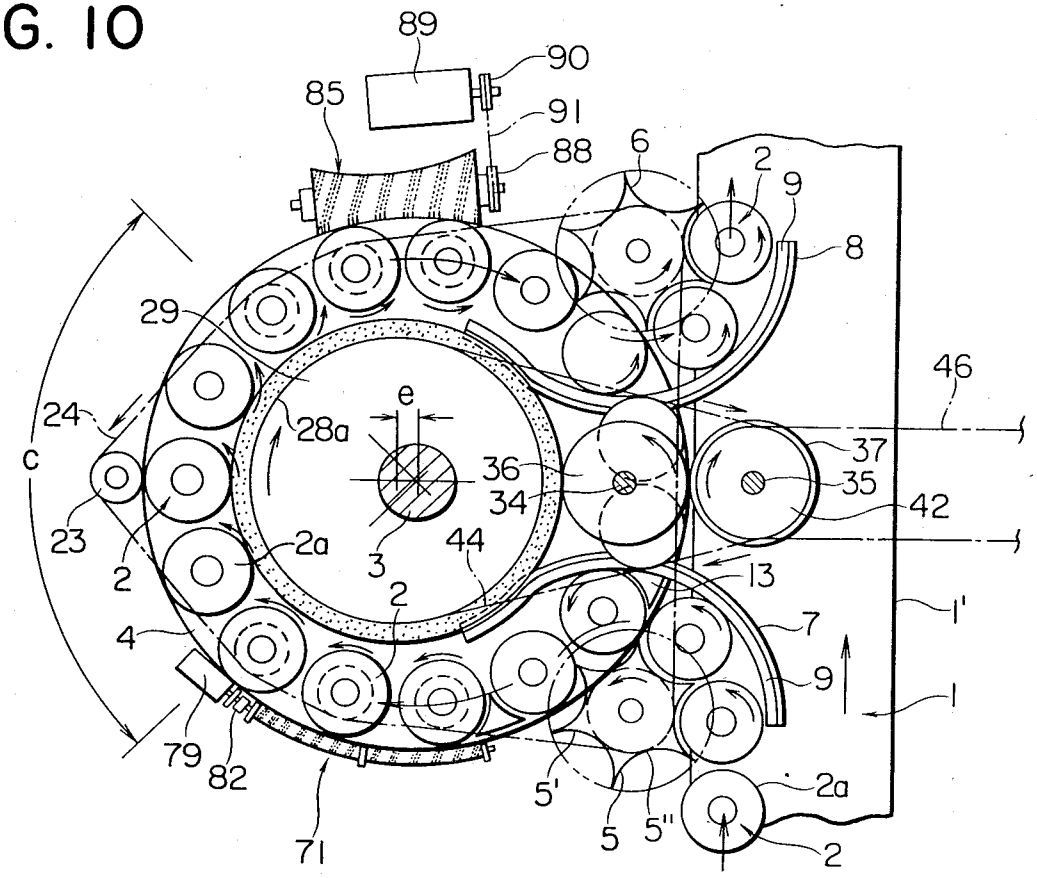
FIG. 10 is a cross sectional plan view similar to those of FIGS. 3 and 4, for showing the action of the coating apparatus for the scratches of the glass bottle according to the present invention.

In the above operation, as shown in FIG. 10, the bottle 2 having transferred by the conveyer 1′ in the conveyance path 1 are spaced apart from each other at desired time intervals by means of both the entrance star wheel 5 and the guide frame 7 to be guided to the bottle mounts 12 through the bridging plates 13 while rotated by being brought into contact in their barrel surfaces with the resilient member 9 of the guide frame 7 and concave portions 5″ between teeth 5′ of the star wheel 5 under the action of the same wheel 5 so that the bottle 2 are further transferred. Thereafter, the vertically movable lever 57 is pressed downward by the cam portion 65 to hold the upper portion of the bottle 2 through its holder head 56 so that the bottle 2 is completely held in its upper and lower portions through the holder head 56 and the bottle mount 12, respectively.

When the thus held bottle 2 is transferred to a position adjacent to the brush roller 71, the bottle 2 is rotated since the pulley 11 of the bottle mount 12 is brought into contact with the V-belt 24, whereby the water droplets produced by condensation of water vapor and adhered to the lower area of the barrel surface 2*a* of the bottle 2 are removed all over the periphery of the bottle 2. Since at this time the removal of the water droplets is performed by the brush roller 71 driven by its own motor 79 over a relatively long distance, i.e., a distance along a plurality of the bottles 2, there is no fear to produce the remains of the water droplets.

When the bottle 2 is transferred to the coating area "C", the upper and the lower areas of the barrel surface 2*a* of the bottle 2 is brought into slidable contact with the coating portions 28*a*, 28*a*′ of the coating roller 28 respectively so that the coating liquid, which is fed to the coating portions 28*a*, 28*a*′ of the coating roller 28 through the spray gun 38, feed roller 37 and intermediate roller 36, is applied to the scratches in the upper and the lower areas of the barrel surface 2*a* of the bottle 2 all over the periphery of the bottle 2 since the bottle 2 is rotated under the effect of its frictional contact with the coating roller 28.

In the above operation, in case that it is necessary to increase an amount of the coating liquid to be applied due to many scratches existing in the upper and the lower areas of the barrel surface 2*a* of the bottle 2, the rotational speed of the motor 45 is increased by the control equipment 49 to increase the rotational speed of each of the rollers 28, 36, 37 so that the bottle 2 is rotated at a high-speed to increase an amount of the coating liquid applied thereto in proportion to the increase of the rotational speed thereof. At this time, an amount of the coating liquid to be fed to the coating roller 28 is naturally increased.

In contrast with the above case, in case that it is possible to reduce an amount of the coating liquid to be applied due to few scratches existing in the upper and the lower areas of the barrel surface 2*a* of the bottle 2, the rotational speed of the motor 45 is reduced to reduce the rotational speed of each of the rollers 28, 36, 37 so that the bottle 2 is rotated at a low-speed in conrast with the above case to reduce the amount of the coating liquid applied thereto in proportion to the decrease of the rotational speed thereof.

In application of the coating liquid, when unevenness of the application appears, such unevenness trouble can be avoided by changing a mounting position of the front end of the arm 31 on the coating roller 28 to varying an amount "e" of the eccentricity.

When the bottle 2 is further transferred to a position adjacent to the brush roller 85, the bottle 2 is rotated through several turns since the pulley 11 of the bottle mount 12 is again brought into contact with the V-belt 24, whereby the upper area of the barrel surface 2*a* of the bottle 2, which upper area has been already applied with the coating liquid, is polished by the rotating brush roller 85. Namely, although in the upper area of the barrel surface 2*a* applied with the coating liquid throug the coating portion 28*a* of the coating roller 28 the water droplets usually remains to form fine convex-concave portions, it is possible to finish the upper area of the barrel surface 2*a* all over its application surface to be smooth and frictional by polishing it with the use of the brush roller 85 under both the effect of rubbing-in action with the coating liquid and the effect of water removal action of the polishing operation.

After the above polishing finishing operation of the barrel surface 2*a*, the bottles 2 are discharged into the conveyance path 1 from the bottle mounts 12 of the rotary disc 4 through the bridging plates 13 under the action of the exit star wheel 6 and the guide frame 8 while spaced apart from each other at the desired time intervals as is in the entrance star wheel 5.

As described above, the scratches appearing in the upper and the lower areas of the barrel surface 2*a* of the bottle 2 which has been transferred through the conveyer 1' are sequentially coated with the coating liquid to be screened all over the peripheries of the upper and the lower areas of the barrel surface 2*a* of the bottle 2.

Figure 11:
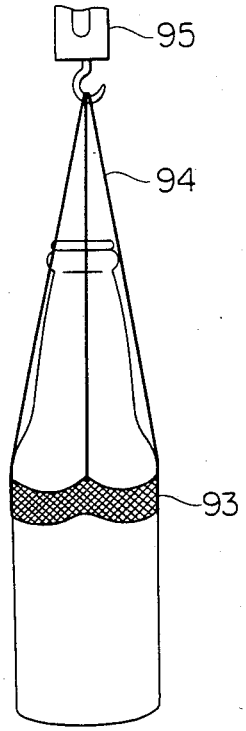
FIG. 11 is a perspective view showing a slippage test of the upper area of the barrel surface of the bottle.
Figure 12:
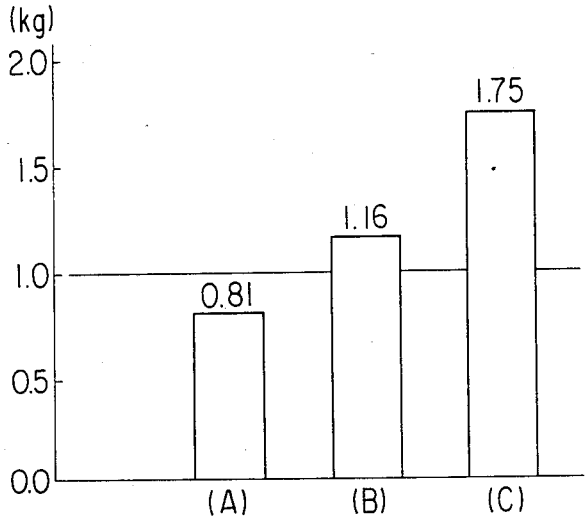
FIG. 12 is a graph showing the result of the test shown in FIG. 11.

As shown in FIG. 11, an elastic band 93 of a nylon stocking is attached to the upper area of the barrel surface 2*a* of the bottle which has been applied with the coating liquid as described above, and is suspended from a spring balance 95 having a scale up to 2 Kg-force through three strings 94 to perform a slippage test in which a slippage resistance of the barrel surface 2*a* of the bottle is measured as a value at which the bottle held by the elastic band 93 begins to slip in the band 93, which value is compared with both that of the barrel surface 2*a* wiped away by the conventional wiper belt as described above and that of the barrel surface 2*a* not applied with the coating liquid, whereby the results shown in FIG. 12 are obtained. As is clear from FIG. 12, it is found that, though generally speaking there is no feeling of slippage if the slippage resistance is over 1 Kg-force, the barrel surface 2*a* of the bottle wiped away by the conventional wiper belt tends to slip if the slippage resistance is 0.81 Kg-force as shown in "A" of FIG. 12 and taht the slippage resistance of the barrel surface 2*a* polished by the brush roller according to the present invention is 1.16 Kg-force as shown in "B" of FIG. 12 to make its slippage hard as in the barrel surface 2*a* not applied with the coating liquid a slippage of which barrel surface 2*a* is 1.75 Kg-force as shown in "C" of FIG. 12. Further, as is clear from the above, it is also found that the thus polished barrel surface 2*a* according to the present invention is smooth since the slippage resistance thereof, i.e., 1.16 Kg-force is nearer to the 1 Kg-force than that (1.75 Kg-force) of the barrel surface 2*a* not applied with the coating liquid.

Figure 13:
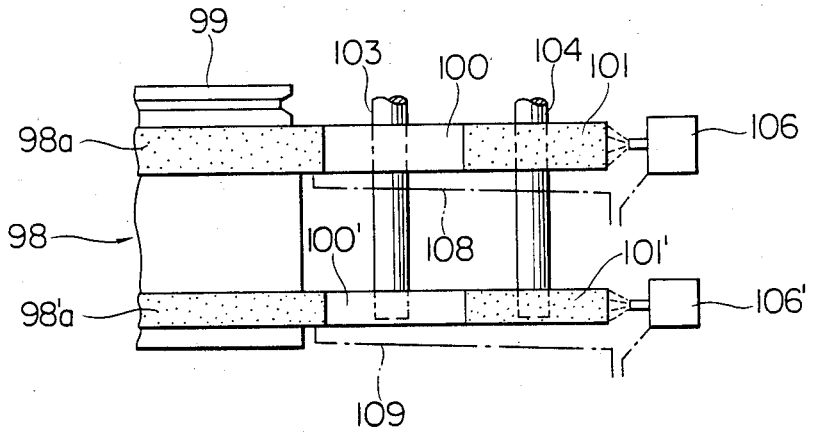
FIG. 13 is an enlarged front view of another embodiment of the coating liquid feed portion.

FIG. 13 shows an embodiment of the feed portion for feeding the coating liquid to the coating roller, wherein the numeral 98 designates a coating roller provided with coating portions 98*a* and 98*a'* in its upper and lower peripheral surfaces, which coating portions 98*a* and 98*a'* have sponge-linings in their peripheries respectively as is in the above embodiment. On a top of the coating roller 98 a pulley 99 is mounted. The numerals 100, 100' and the numerals 101, 101' designate intermediate rollers, which are made os stainless steel and mounted on a rotary shaft 103, and feed rollers which have sponge-linings in their peripheries and mounted on a rotary shaft 104, respectively. The intermediate rollers 100 and 100' rotatably abut against the feed rollers 101 and 101', respectively, and also rotatably abut against the coating portions 98*a* and 98*a'* of the coating roller 98, respectively. The coating liquid is pumped from two tanks (not shown) and fed to the spray guns 106 and 106' which spray the feed rollers 101, 101' with the coating liquid. As a coating liquid to be sprayed through the spray gun 106, it is possible to use the emulsion containing dimethyl silicone as its main dispersoid component as described above, while, as a coating liquid to be sprayed through the spray gun 106', it is possible to use a relatively hydrophobic liquid prepared by incorporating a large amount of phenyl radical into the above emulsion. The coating liquid sprayed from the spray gun 106 is transferred to the intermediate roller 100 through the feed roller 101 to be uniformed in thickness into a thin film, and thereafter further transferred to the coating portion 98*a* of the coating roller 98, while the coating liquid sprayed from the spray gun 106' is transferred to the intermediate roller 100' through the feed roller 101' to be uniformed in thickness into a thin film and then further transferred to the coating portion 98*a'* of the coating roller 98 as is in the above. A tray 108 is provided under the feed roller 101 and the intermediate roller 100, while another tray 109 is provided under the feed roller 101' and the intermediate roller 100', whereby an excess amount of the coating liquid is received and accumulated in the trays 108, 109 to be recirculated so as to returned to the above tanks.

Further, it is possible to move up and down the formers comprising: the coating portion 98*a* of the coating roller 98, intermediate roller 100, feed roller 101, spray gun 106 and tray 108 relative to the latters comprising: the coating portion 98*a'*, intermediate roller 100', feed roller 101', spray gun 106', and tray 109, respectively to make it possible that according to a height of the barrel surface of the bottle to be coated, namely, in case that the bottle is a small one such as an aerated drink bottle, the above-mentioned formers is moved downward from a position having been adjusted for the beer bottle as shown in the drawings to make a vertical distance between the formers and the latters narrower so taht the coating portions 98*a* and 98*a'* of the coating roller 98 are brought into contact with the upper and the lower areas of the barrel surface of such small bottle. In this case, although a driving mechanism for moving up and down the above-mentioned formers and the latters is not shown in the drawings, it is possible to employ a conventional mechanism as such driving mechanism.

In use of the above embodiment of the present invention, it is possible to screen the scratches appearing in the upper and the lower areas of the barrel surface of the bottle since different types of the coating liquids may be separately applied to such upper and lower areas of the barrel surface of the bottle through the coating portions 98*a* and 98*a'* of the coating roller 98 when the bottle is transferred to the coating area "C" while brought into slidable contact with the coating portions 98*a* and 98*a'* in its upper and lower areas of the barrel surface thereof, respectively. Namely, since the hydrophilic coating liquid is applied to the upper area of the barrel surface 2*a* of the bottle, it is possible to reduce the possibility of slippage of the upper area of the barrel surface 2a as usual. On the other hand, since the hyrophobic coating liquid is applied to the lower area of the barrel surface 2a of the bottle, it is possible to perfectly conduct the application operation to such lower area of the barrel surface 2a with the coating liquid so that unevenness in such application is avoided. This is an advantage of the present invention.

The present invention has been described in detail sufficient to enable one of ordinary skill in the art to make and use the same. It is believed that certain modifications and alterations of the preferred embodiments will occur to others upon a reading and understanding of the specification, and it is intended to include all such alterations and modifications as part of the present invention, insofar as they come within the scope of the appended claims.

What is claimed is:

1. A coating apparatus for scratches of a glass bottle comprising: in combination a rotary disc which is mounted on a central shaft rotated by a first driving unit and is provided with a bottle-fed portion in one side of its rotational direction and a bottle-discharge portion in another side of its rotational direction; a coating roller which is rotatably supported by said central shaft of said rotary disc and makes its rotational center eccentric relative to a center of said central shaft toward a direction opposite to a direction where the bottle-feed and bottle-discharge portions of said rotary disc exist so that a peripheral surface of said coating roller is brought into slidable contact with a barrel surface of said bottle transferred on said rotary disc to apply coating liquid to the barrel surface of said bottle; a feed roller which abuts against the peripheral surface of said coating roller to rotate together with the same so that the coating liquid is fed to the peripheral surface of said coating roller from said feed roller; a feed member for feeding the coating liquid to a peripheral surface of said feed roller; a second driving unit rotatable together with said feed roller and said coating roller; a control equipment for controlling the output of said second driving unit to regulate the rotational speed of each of said rollers; and a bottle holding member for holding an upper and a lower portion of said bottle in a manner that, in application of the coating liquid through said coating roller, said bottle is held rotatably relative to said rotary disc to enable the barrel surface of said bottle to be brought into slidable contact with the peripheral surface of said coating roller.

2. The coating apparatus for the scratches of the glass bottle as set forth in claim 1 further comprising: in combination, a lateral rotary brush roller which is disposed adjacent to an outer peripheral surface position in a bottle-discharge side of said rotary disc and slidably abuts in its outer peripheral surface against an upper portion of the coating liquid application area of the barrel surface of said bottle which is transferred while rotated and applied in its barrel surface with the coating liquid through said coating roller, so that the application area of said bottle which has been applied with the coating liquid is polished by said brush roller; and a driving unit for rotatably driving said brush roller.

3. The coating apparatus for the scratches of the glass bottle as set forth in claim 1 further comprising: in combination, a lateral rotary brush roller which is disposed adjacent to an outer peripheral surface position in a bottle-feed side of said rotary disc and slidably abuts in its outer peripheral surface against a lower portion of the coating liquid application area of the barrel surface of said bottle which is transferred from a bottle-feed portion while rotated so that the condensed water vapor adhered to the lower area of the barrel surface of said bottle is removed by said rotary brush roller; and a driving unit for rotatably driving said brush roller.

4. The coating apparatus for the scratches of the glass bottle as set forth in claim 1, wherein:

said coating roller is provided with coating portions in its upper and lower peripheral surfaces which coating portions apply the coating liquid to the corresponding upper and lower areas of the barrel surface of said bottle; and said feed roller is constructed of two rollers which may apply different types of the coating liquid to peripheral surfaces of the coating portions of said coating roller, respectively.

* * * * *

UNITED STATES PATENT AND TRADEMARK OFFICE

CERTIFICATE OF CORRECTION

PATENT NO. : 4 586 458

DATED : May 6, 1986

INVENTOR(S) : Kazuo Taguchi et al

It is certified that error appears in the above-identified patent and that said Letters Patent is hereby corrected as shown below:

Column 11, line 23; change "bottle-fed" to ---bottle-feed---.

Signed and Sealed this

Twenty-first Day of October, 1986

[SEAL]

*Attest:*

DONALD J. QUIGG

*Attesting Officer*

*Commissioner of Patents and Trademarks*